US010921040B2

(12) United States Patent
Chung et al.

(10) Patent No.: US 10,921,040 B2
(45) Date of Patent: Feb. 16, 2021

(54) REFRIGERATOR

(71) Applicant: LG ELECTRONICS INC., Seoul (KR)

(72) Inventors: Myungjin Chung, Seoul (KR); Kyungseok Kim, Seoul (KR); Kyeongyun Kim, Seoul (KR); Giseok Seong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 91 days.

(21) Appl. No.: 16/204,824

(22) Filed: Nov. 29, 2018

(65) Prior Publication Data

US 2019/0178557 A1 Jun. 13, 2019

(30) Foreign Application Priority Data

Dec. 13, 2017 (KR) ..... 10-2017-0171642

(51) Int. Cl.
*F25D 11/02* (2006.01)
*F25D 29/00* (2006.01)

(52) U.S. Cl.
CPC ..... *F25D 11/022* (2013.01); *F25D 29/00* (2013.01); *F25B 2600/2511* (2013.01); *F25D 2600/04* (2013.01); *F25D 2700/121* (2013.01); *F25D 2700/122* (2013.01)

(58) Field of Classification Search
CPC ..... F25B 2600/2511; F25D 11/022
USPC ..... 62/193
See application file for complete search history.

(56) References Cited

U.S. PATENT DOCUMENTS

2007/0137230 A1* 6/2007 Bae ..... F25B 5/04 62/198
2009/0113924 A1* 5/2009 Bae ..... F25D 17/065 62/447
2010/0154443 A1* 6/2010 Chun ..... F25D 29/00 62/80
2011/0209490 A1* 9/2011 Mijanovic ..... F25B 5/02 62/190
2013/0086928 A1* 4/2013 Cho ..... F25D 21/006 62/80
2015/0121927 A1* 5/2015 Lee ..... F25B 5/02 62/157

(Continued)

FOREIGN PATENT DOCUMENTS

CN 2655138 Y 11/2004
DE 102015200728 A1 7/2016
EP 3104105 A2 12/2016

(Continued)

OTHER PUBLICATIONS

Search Report of European Patent Office in Appl'n No. 18211984.2, dated Apr. 15, 2019.

*Primary Examiner* — Henry T Crenshaw
(74) *Attorney, Agent, or Firm* — Dentons US LLP

(57) ABSTRACT

A refrigerator includes a compressor, a condenser, a first evaporator connected with a first evaporator inlet path and a first evaporator outlet path, a second evaporator connected with a second evaporator inlet path and a second evaporator outlet path, a third evaporator connected with a third evaporator inlet path and a third evaporator outlet path, a path switching device, and a controller for controlling the compressor and the path switching device based on at least one mode.

27 Claims, 6 Drawing Sheets

(56) References Cited

U.S. PATENT DOCUMENTS

2016/0363360 A1* 12/2016 Kim ..... F25B 41/04

FOREIGN PATENT DOCUMENTS

| | | | |
|---|---|---|---|
| KR | 10-0608680 | B1 | 8/2006 |
| KR | 10-0889966 | B1 | 3/2009 |
| KR | 10-1394328 | B1 | 5/2014 |

* cited by examiner

REFRIGERATOR

This application claims priority under 35 U.S.C. 119 and 365 to Korean Patent Application No. 10-2017-0171642, filed on Dec. 13, 2017 in the Korean Intellectual Property Office, the disclosure of which is incorporated herein by reference.

BACKGROUND

1. Field of the Disclosure

The present disclosure relates to a refrigerator, and more particularly, to a refrigerator having a plurality of evaporators for cooling a plurality of storage chambers.

2. Discussion of the Related Art

A refrigerator is a device for cooling or storing objects to be cooled (hereinafter, referred to as food) at a low temperature to prevent food from spoiling or going sour, or preserve medicines and cosmetics.

The refrigerator includes a main body having at least one storage chamber formed therein and a freezing cycle device for cooling the storage chamber. The main body may include a plurality of storage chambers having different temperature ranges.

In recent years, refrigerators for storing foods, which need to be stored at a constant temperature, such as wine, have gradually increased. Korean patent registration No. 10-0889966 B1 (published on Mar. 24, 2009) discloses a wine refrigerator capable of refrigerating wine.

The wine refrigerator disclosed in Korean patent registration No. 10-0889966 B1 (published on Mar. 24, 2009) includes a wine storage space in which wine is received, a freezing system for cooling air inside of the wine storage space, a heater for partially heating the air inside of the wine storage space, an evaporator temperature sensor for measuring the temperature of the evaporator of the freezing system, and a controller for controlling operation of the freezing system and the heater. Since circulated air is generated in the wine refrigerator by the heater, the internal temperature of the wine refrigerator may be maintained in an optimal temperature range. In addition, in such a wine refrigerator, a first evaporator, a second evaporator and a third evaporator respectively perform evaporation in an upper, middle and lower layers of the wine storage space, thereby separately performing temperature control.

However, the above-described wine refrigerator may store wine and food having a storage temperature close to that of wine, but cannot suitably store food having a lower storage temperature than wine, such as meat, together with wine.

Meanwhile, when white wine and red wine having different optimal storage temperatures are stored in one wine storage chamber, it is difficult to store both white wine and red wine at an optimal temperature. The quality of at least one of white wine and red wine may be lowered.

SUMMARY

An object of the present disclosure is to provide a refrigerator capable of storing food having a relatively high storage temperature than the other foods at a constant temperature as much as possible while respectively storing various foods having different optimal storage temperatures at optimal temperatures.

To achieve the above objects, there is provided a refrigerator including a main body in which a first storage chamber, a second storage chamber and a third storage chamber are formed, a compressor connected with a compressor suction path and a compressor discharge path, a condenser connected with the compressor discharge path and connected with a condenser outlet path, a first evaporator connected with a first evaporator inlet path and a first evaporator outlet path to cool the first storage chamber, a second evaporator connected with a second evaporator inlet path and a second evaporator outlet path to cool the second storage chamber, a third evaporator connected with a third evaporator inlet path and a third evaporator outlet path to cool the third storage chamber, a path switching device connected with the condenser outlet path and connected to the first evaporator inlet path, the second evaporator inlet path and the third evaporator inlet path, and a controller configured to control the compressor and the path switching device based on at least one mode.

The second evaporator outlet path is connected to the first evaporator inlet path, wherein the first evaporator outlet path and the third evaporator outlet path are connected to the compressor suction path.

A maximum target temperature of the third storage chamber is lower than each of a maximum target temperature of the first storage chamber and a maximum target temperature of the second storage chamber.

A valve for preventing refrigerant of the compressor suction path from flowing back to the third evaporator may be provided on the third evaporator outlet path.

The second storage chamber may be located between the first storage chamber and the third storage chamber.

A difference between a target temperature upper-limit value and a target temperature lower-limit value of each of the first storage chamber and the second storage chamber may be less than a difference between a target temperature upper-limit value and a target temperature lower-limit value of the third storage chamber.

The controller may selectively perform a first mode for controlling the path switching device in a second evaporator supply mode such that refrigerant is supplied to both the first evaporator and the second evaporator, a second mode for controlling the path switching device in a first evaporator supply mode such that refrigerant is supplied to the first evaporator, and a third mode for controlling the path switching device in a third evaporator supply mode such that refrigerant is supplied to the third evaporator.

The controller may perform the first mode until a temperature of the second storage chamber is satisfied, perform the second mode until a temperature of the first storage chamber is satisfied, after the temperature of the second storage chamber is satisfied, and perform the third mode until a temperature of the third storage chamber is satisfied, after the temperature of the first storage chamber is satisfied.

The controller may start the first mode if the temperature of the second storage chamber is dissatisfied, and terminate the first mode if the temperature of the second storage chamber is satisfied.

The controller may start the second mode if the temperature of the first storage chamber is dissatisfied, and terminate the second mode if the temperature of the first storage chamber is satisfied.

The controller may terminate the third mode and resumes the first mode, if the temperature of the third storage chamber is satisfied and the temperature of the second storage chamber is dissatisfied in the third mode.

The controller may terminate the third mode and then turn off the compressor until the temperature of the second storage chamber becomes dissatisfied, if the temperature of the third storage chamber is satisfied and the temperature of the second storage chamber is satisfied in the third mode, and resume the first mode if the temperature of the second storage chamber is dissatisfied while the compressor is in an off state.

A temperature range of the second storage chamber may be equal to or lower than that of the first storage chamber and may be higher than that of the third storage chamber.

A temperature range of the first storage chamber may be 12° C. to 18° C., and a temperature range of the second storage chamber may be 12° C. to 18° C. or 6° C. to 11° C.

A temperature range of the third storage chamber may be 0° C. to 7° C. or −2° C. to 0° C. or −24° C. to −16° C.

DETAILED DESCRIPTION OF THE PREFERRED EMBODIMENTS

Hereinafter, detailed embodiments of the present disclosure will be described in detail with reference to the accompanying drawings.

Figure 1:
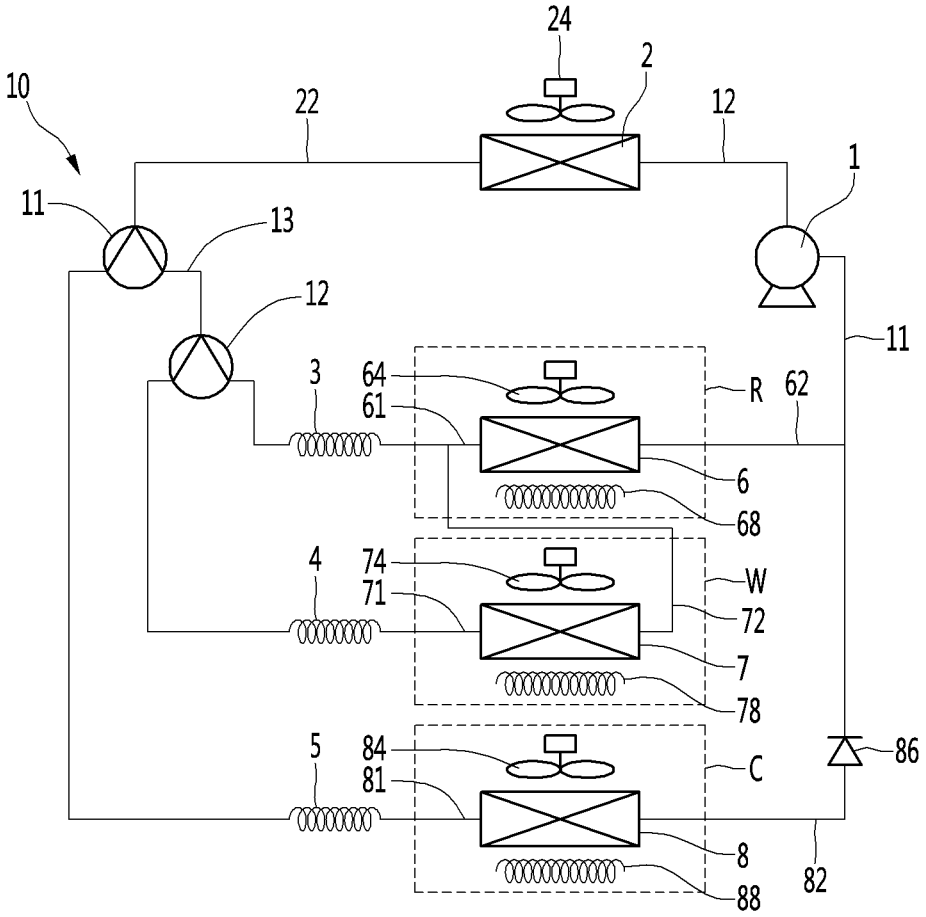
FIG. 1 is a diagram showing a configuration of a refrigerator according to an embodiment of the present disclosure.
Figure 2:
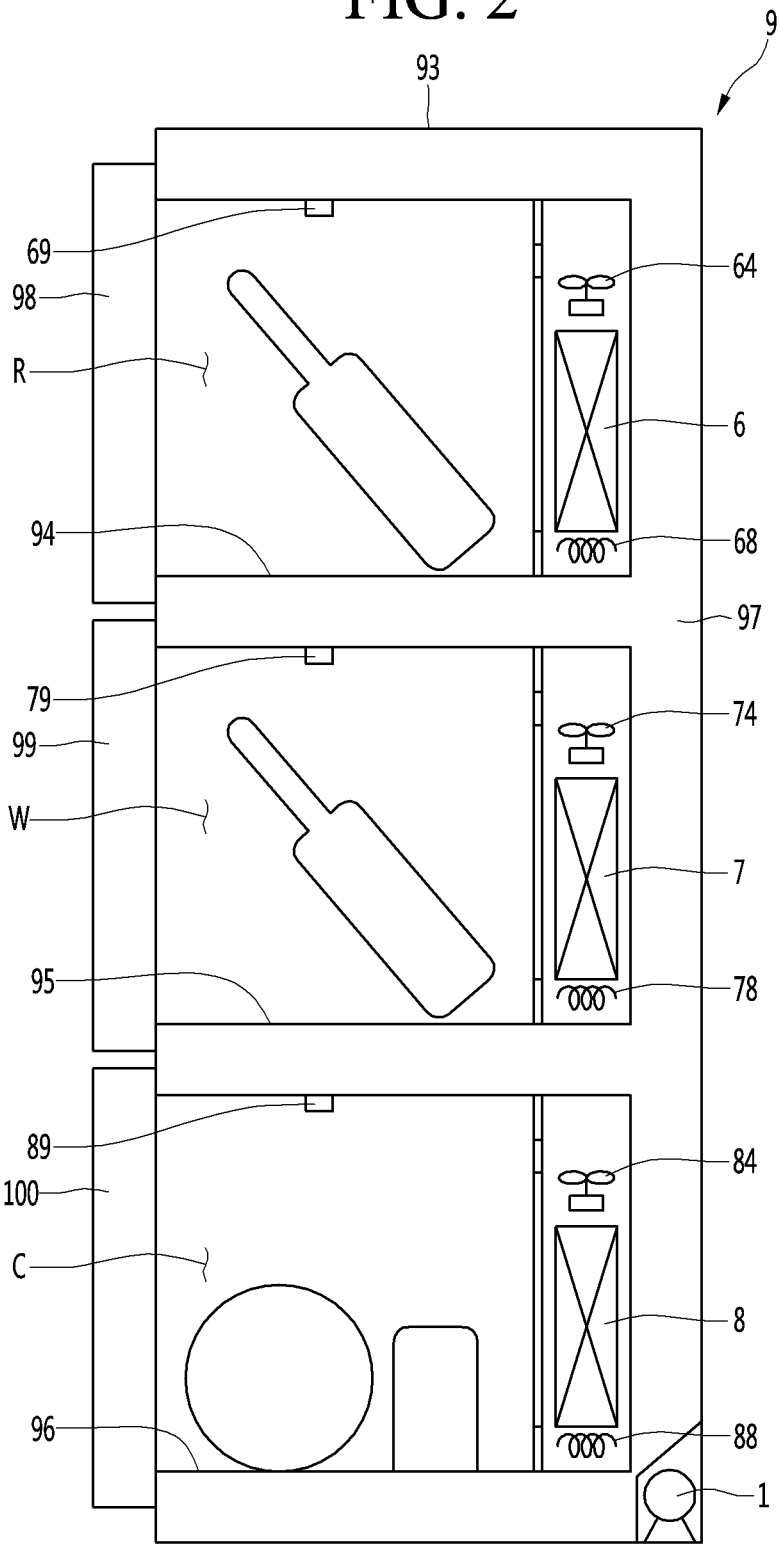
FIG. 2 is a cross-sectional view showing an inside of the refrigerator according to the embodiment of the present disclosure.
Figure 3:
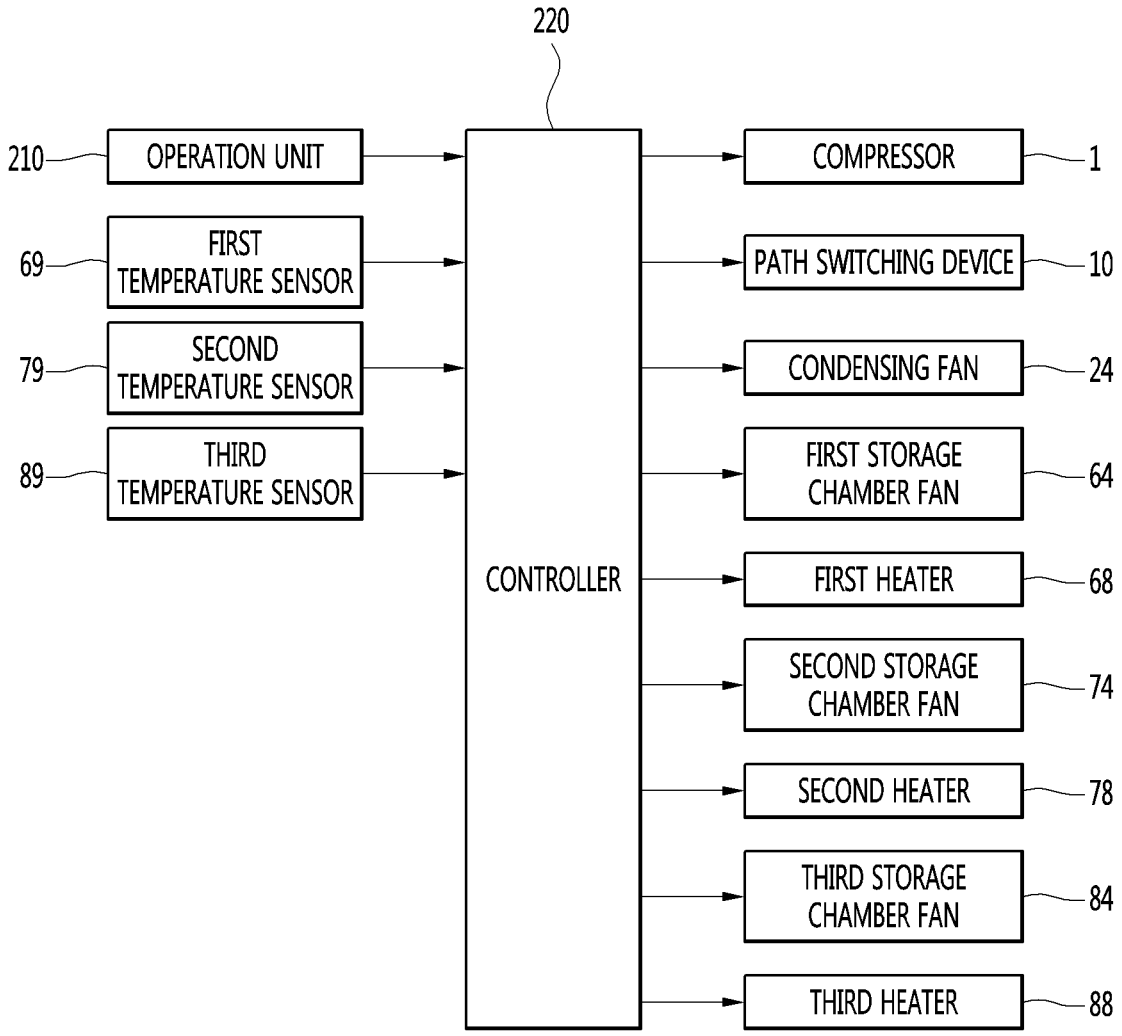
FIG. 3 is a control block diagram of the refrigerator according to the embodiment of the present disclosure.

FIG. 1 is a diagram showing a configuration of a refrigerator according to an embodiment of the present disclosure, FIG. 2 is a cross-sectional view showing an inside of the refrigerator according to the embodiment of the present disclosure, and FIG. 3 is a control block diagram of the refrigerator according to the embodiment of the present disclosure.

The refrigerator of the present embodiment includes a compressor 1, a condenser 2, at least one expansion device, a plurality of evaporators 6, 7 and 8, a main body 9 in which a plurality of storage chambers R, W and C are formed, and a path switching device 10 for switching a path of refrigerant. The plurality of storage chambers R, W and C are cooled by the plurality of evaporators 6, 7 and 8.

The compressor 1, the condenser 2, the at least one expansion device, and the plurality of evaporators 6, 7 and 8 may be installed in the main body 9.

The plurality of storage chambers R, W and C formed in the main body 9 may include a first storage chamber R, a second storage chamber W and a third storage chamber C.

The first storage chamber R, the second storage chamber W and the third storage chamber C may be partitioned and formed in the main body 9 and may be independent storage spaces.

Any one of the first storage chamber R, the second storage chamber W and the third storage chamber C may be separated from the other storage chambers by a plurality of barriers. The plurality of barriers may include a first barrier separating the second storage chamber W from the first storage chamber R and a second barrier separating the second storage chamber W from the third storage chamber C.

The main body 9 may include an outer case 93 forming appearance thereof, a first inner case 94 in which the first storage chamber R is formed, a second inner case 95 in which the second storage chamber W is formed, and a third inner case 96 in which the third storage chamber C is formed.

The main body 9 may include an insulator 97 for insulating the inside of the refrigerator. The insulator 97 may be disposed between each of the first inner case 94, the second inner case 95 and the third inner case 96, and the outer case 93, may be disposed between the first inner case 94 and the second inner case 95, and may be disposed between the second inner case 95 and the third inner case 96.

The second inner case 95 may be located between the first inner case 94 and the third inner case 96.

The main body 9 may include a first door 98 for opening or closing the first storage chamber R, a second door 99 for opening or closing the second storage chamber W, and a third door 100 for opening or closing the third storage chamber C.

The refrigerator of the present embodiment may be a wine refrigerator which mainly refrigerates wine and also stores other foods having a storage temperature different from that of wine. Some of the plurality of storage chambers R, W and C may be a wine-only storage chamber capable of mainly storing wine and the other of the plurality of storage chambers R, W and C may be normal storage chambers capable of storing the other foods having a lower storage temperature than wine.

Meanwhile, some of the plurality of storage chambers R, W and C may be temperature range fixed storage chambers having fixed temperature ranges and the other of the plurality of storage chambers R, W and C may be temperature range variable storage chambers having variable temperature ranges.

The temperature range of the storage chamber may be varied and a user may select a specific temperature in the temperature range of the storage chamber as a desired temperature.

In the present embodiment, the first storage chamber R may be a storage chamber capable of mainly refrigerating red wine. In addition, the second storage chamber W may be a storage chamber capable of selectively refrigerating red wine and white wine. Meanwhile, the third storage chamber C may be a storage chamber having a lower temperature range than each of the first storage chamber R and the second storage chamber W.

The first storage chamber R may have a fixed temperature range. The temperature range of the first storage chamber R may be, for example, set in a range of 10° C. to 20° C., and, preferably, in the storage temperature range of red wine, for example, 12° C. to 18° C. The user may input a target temperature of the first storage chamber R through an operation unit 210, and the target temperature of the first storage chamber R may be a specific temperature selected by the user in the temperature range of the first storage chamber R of 12° C. to 18° C.

The temperature range of the second storage chamber W may be set higher than that of the third storage chamber C. The second storage chamber W may be a wine chamber having a temperature range selected by the user from among the plurality of temperature ranges. The plurality of temperature ranges may include a same temperature range as the first storage chamber R and a lower temperature range than the first storage chamber R. That is, the temperature range of the second storage chamber W may be equal to that of the first storage chamber R or lower than that of the first storage chamber R.

An example of the plurality of temperature ranges may be set in a range of 10° C. to 20° C. and, preferably in the temperature range of red wine of, for example, 12° C. to 18° C.

Another example of the plurality of temperature ranges may be set in a range of 4° C. to 13° C. and, preferably in the temperature range of white wine of, for example, 6° C. to 11° C.

The refrigerator may include the operation unit 210 capable of selecting the temperature range of the second storage chamber W. The user may set the temperature range of the second storage chamber W to be equal to that of the first storage chamber R or set the temperature range of the second storage chamber W to be lower than that of the first storage chamber R, using the operation unit 210.

The user may set the second storage chamber W to a red wine mode through the operation unit 210, and, in this case, the second storage chamber W may become a red wine chamber cooled to the temperature range of red wine of, for example, 12° C. to 18° C.

The user may set the second storage chamber W to a white wine mode through the operation unit 210, and, in this case, the second storage chamber W may be a white wine chamber cooled to the temperature range of white wine of, for example, 6° C. to 11° C.

The user may input the target temperature of the second storage chamber W through the operation unit 210. In this case, the target temperature of the second storage chamber W may be a specific temperature (e.g., 16° C.) selected by the user in the temperature range of red wine of 12° C. to 18° C. or a specific temperature (e.g., 8° C.) selected by the user in the temperature range of white wine of 6° C. to 11° C.

Meanwhile, the third storage chamber C may be a switchable chamber having a temperature range selected from among the plurality of temperature ranges.

In addition, the third storage chamber C may be a normal storage chamber having a lower temperature range than the first storage chamber R and the second storage chamber W. The temperature range of the third storage chamber C may be switched similarly to the second storage chamber W. In this case, the third storage chamber C may be a normal switchable chamber.

The user may set the third storage chamber C to a refrigerating chamber mode using the operation unit 210. In this case, the temperature range of the third storage chamber C may be set to the temperature range of the refrigerating chamber of 0° C. to 7° C. In addition, the user may input a desired refrigerating temperature using the operation unit 210, and the target temperature of the third storage chamber C may be a specific temperature (e.g., 4° C.) selected by the user in a range of 0° C. to 7° C.

The user may set the third storage chamber C to a freezing chamber mode using the operation unit 210. In this case, the temperature range of the third storage chamber C may be set to the temperature range of the freezing chamber of −24° C. to −16° C. In addition, the user may input a desired freezing temperature using the operation unit 210, and the target temperature of the third storage chamber C may be a specific temperature (e.g., −17° C.) selected by the user in a range of −24° C. to −16° C.

The user may set the third storage chamber C to a special mode (e.g., a kimchi storage mode) using the operation unit 210. In this case, the temperature range of the third storage chamber C may be set to the temperature range of the special mode of −2° C. to 0° C. In addition, the user may input a desired storage chamber temperature using the operation unit 210, and the target temperature of the third storage chamber C may be a specific temperature (e.g., −1° C.) selected by the user in a range of −2° C. to 0° C.

The maximum target temperature of the third storage chamber C may be lower than each of the maximum target temperatures of the first storage chamber R and the second storage chamber W.

Each of the first storage chamber R and the second storage chamber W may mainly store food which needs to be stored at a constant temperature (e.g., wine) and the maximum target temperature thereof may be higher than the third storage chamber C. The third storage chamber C may store food having a lower storage temperature than white wine or red wine and the maximum target temperature thereof may be lower.

For example, the temperature range of the third storage chamber C may be −24° C. to −16° C., the temperature range of the first storage chamber R may be 12° C. to 18° C., and the temperature range of the second storage chamber W may be 6° C. to 11° C. In this case, −16° C. which is the maximum target temperature of the third storage chamber C is lower than each of 18° C. which is the maximum target temperature of the first storage chamber R and 11° C. which is the maximum target temperature of the second storage chamber W.

Meanwhile, a difference between the target temperature upper-limit value and the target temperature lower-limit value of each of the first storage chamber R and the second storage chamber W may be lower than a difference between the target temperature upper-limit value and the target temperature lower-limit value of the third storage chamber C.

Since each of the first storage chamber R and the second storage chamber W stores food which needs to be stored at a constant temperature (that is, wine), a temperature change range thereof may be controlled not to be wide.

In contrast, since the third storage chamber C stores food having a lower storage temperature than white wine or red wine, the temperature change range of the third storage chamber C may be controlled to be greater than that of each of the first storage chamber R and the second storage chamber W, such that the third storage chamber C is sufficiently cooled.

The target temperature upper-limit value of the first storage chamber R is higher than the target temperature of the first storage chamber R by 0.5° C., and the target temperature lower-limit value of the first storage chamber R may be lower than the target temperature of the first storage chamber R by 0.5° C.

In addition, the target temperature upper-limit value of the second storage chamber W is higher than the target temperature of the second storage chamber W by 0.5° C., and the target temperature lower-limit value of the second storage chamber W may be lower than the target temperature of the second storage chamber W by 0.5° C.

In contrast, the target temperature upper-limit value of the third storage chamber C is higher than the target temperature of the third storage chamber C by 1° C. or 1.5° C., and the target temperature lower-limit value of the third storage chamber C may be lower than the target temperature of the third storage chamber C by 1° C. or 1.5° C.

Meanwhile, the second storage chamber W may be located between the first storage chamber R and the third storage chamber C. The first storage chamber R may be configured as an upper chamber located above the second storage chamber W, the third storage chamber C may be configured as a lower chamber located below the second storage chamber W, and the second storage chamber W may be configured as a middle chamber located between the first storage chamber R and the third storage chamber C.

In this case, the second storage chamber W capable of refrigerating white wine or red wine may be located between the third storage chamber C having a lower temperature range than each of the first storage chamber R and the second storage chamber W, and the first storage chamber R capable of mainly refrigerating red wine.

The compressor 1 may be connected with a compressor suction path 11 and a compressor discharge path 12. The compressor 1 may suck and compress a refrigerant of the compressor suction path 11 and then discharge the refrigerant to the compressor discharge path 12.

The condenser 2 may be connected with the compressor discharge path 12. The condenser 2 may be connected with a condenser outlet path 22. Refrigerant compressed in the compressor 1 and then discharged through the compressor discharge path 12 may be introduced into the condenser 2, condensed while passing through the condenser 2, and then discharged through the condenser outlet path 22.

The refrigerator may further include a condensing fan 24 for blowing outside air to the condenser 2.

The refrigerator may include a plurality of expansion devices 3, 4 and 5, and the plurality of expansion devices 3,4 and 5 may expand refrigerant flowing to the evaporators 6, and 8 after being condensed in the condenser 2. The plurality of expansion devices 3, 4 and 5 may be capillary tubes or electronic expansion valves.

The plurality of expansion devices 3, 4 and 5 may one-to-one correspondence to the plurality of evaporators 6, 7 and 8. The number of evaporators may be equal to the number of storage chambers. The plurality of evaporators 6, 7 and 8 may one-to-one correspondence to the plurality of storage chambers R, W and C.

The plurality of evaporators 6, 7 and 8 may include a first evaporator 6 for cooling the first storage chamber R, a second evaporator 7 for cooling the second storage chamber W and a third evaporator 8 for cooling the third storage chamber C.

The plurality of expansion devices 3, 4 and 5 may include a first expansion device 3 installed in a first evaporator inlet path 61 to decompress refrigerant flowing toward the first evaporator 6; a second expansion device 4 installed in a second evaporator inlet path 71 to decompress refrigerant flowing toward the second evaporator 7 and a third expansion device 5 installed in a third evaporator inlet path 81 to decompress refrigerant flowing toward the third evaporator 8.

The first evaporator 6 and the second evaporator 7 may be connected in series, and the first evaporator 6 and the second evaporator 7 connected in series may be connected to the third evaporator 8 in parallel.

The first evaporator 6 may be connected with the first evaporator inlet path 61 and a first evaporator outlet path to cool the first storage chamber R. The first evaporator outlet path 62 may be connected to the compressor suction path 11. One end of the first evaporator outlet path 62 may be connected to the first evaporator 6 and the other end of the first evaporator outlet path 62 may be connected between a valve 86 and the compressor 1 in a direction in which the refrigerant passing through the third evaporator 8 flows.

The refrigerant, which has passed through the first evaporator 6, may be sucked into the compressor 1 through the first evaporator outlet path 62 and the compressor suction path 11.

The refrigerator may include a first storage chamber fan 64 for circulating cool air of the first storage chamber R to the first evaporator 6 and the first storage chamber R.

The second evaporator 7 may be connected with a second evaporator inlet path 71 and a second evaporator outlet path 72 to cool the second storage chamber W.

The second evaporator outlet path 72 may be connected to the first evaporator inlet path 61. The second evaporator outlet path 72 may be connected between the first expansion device 3 and the first evaporator 6 at the first evaporator inlet path 61. In this case, the second evaporator 7 may be connected to the first evaporator 6 in series, and the refrigerant may sequentially pass through the second evaporator 7, the second evaporator outlet path 72, the first evaporator inlet path 61, the first evaporator 6 and the first evaporator outlet path 62.

The refrigerator may include a second storage chamber fan 74 for circulating cool air of the second storage chamber W to the second evaporator 7 and the second storage chamber W.

The third evaporator 8 may be connected with a third evaporator inlet path 81 and a third evaporator outlet path to cool the third storage chamber C. The third evaporator outlet path 82 may be connected to the compressor suction path 11. The refrigerant, which has passed through the third evaporator 8, may be sucked into the compressor 1 through the third evaporator outlet path 82 and the compressor suction path 11.

A valve 86 for preventing the refrigerant of the compressor suction path 11 from flowing back to the third evaporator 8 may be provided on the third evaporator outlet path 82. The valve 86 may be a check valve for allowing flow in one direction, thereby allowing the refrigerant flowing from the third evaporator 3 to be sucked into the compressor 1.

The refrigerator may first cool the third storage chamber C alone and then cool the first storage chamber R and the second storage chamber W together or cool the first storage chamber R alone. Upon being switched to cooling of the first storage chamber R, the first evaporator 6 has relatively higher pressure than the third evaporator 8, and, when the valve 86 is not installed, some of the refrigerant, which has passed through the first evaporator 6, may flow to the third evaporator 8 having relatively lower pressure than the first evaporator 6. However, if the valve 86 is installed on the third evaporator outlet path 82, the refrigerant flowing to the compressor suction path 11 through the first evaporator outlet path 62 does not flow back to the third evaporator 8 due to the valve 86.

The refrigerator may include a third storage chamber fan 84 for circulating cool air of the third storage chamber C to the third evaporator 8 and the third storage chamber C.

Meanwhile, the refrigerator may further include a first heater 68 disposed in the first storage chamber R to heat the first storage chamber R. The first heater 68 may be turned on while the compressor 1 is in an off state, and, when the first storage chamber fan 64 is driven, cool air of the first storage chamber R may be circulated to the first heater 68 and the first storage chamber R to heat the first storage chamber R.

The refrigerator may further include a second heater 78 disposed in the second storage chamber W to heat the second storage chamber W. The second heater 78 may be turned on while the compressor 1 is in an off state, and, when the second storage chamber fan 74 is driven, cool air of the second storage chamber W may be circulated to the second heater 78 and the second storage chamber W to heat the second storage chamber W.

The refrigerator may further include a third heater 88 disposed in the third storage chamber C to heat the third storage chamber C. The third heater 88 may be disposed around the third evaporator 8 to defrost the third evaporator 8.

The third heater 88 may be turned on while the compressor 1 is in an off state, and, when the third storage chamber fan 84 is driven, cool air of the third storage chamber C may be circulated to the third heater 88, the third evaporator 8 and the third storage chamber C to heat the third evaporator 8 and defrost the third evaporator 8.

The path switching device 10 may regulate the refrigerant flowing through the first evaporator 6, the second evaporator 7 and the third evaporator 8.

The path switching device 10 may be connected with the condenser outlet path 22. In addition, the path switching device 10 may be connected with the first evaporator inlet path 61, the second evaporator inlet path 71 and the third evaporator inlet path 81.

The path switching device 10 may be a single valve. In this case, the path switching device 10 may be a four-way valve connected to the condenser outlet path 22, the first evaporator inlet path 61, the second evaporator inlet path 71 and the third evaporator inlet path 81.

The path switching device 10 may be a combination of a plurality of valves and, in this case, the path switching device 10 may include a first three-way valve 11 connected with the condenser outlet path 22 and the third evaporator inlet path 81, a second three-way valve 12 connected with the first evaporator inlet path 61 and the second evaporator inlet path 71, and a three-way valve connection path 13 connecting the first three-way valve 11 with the second three-way valve 12.

The refrigerator may include a first temperature sensor 69 disposed in the first storage chamber R to sense the temperature of the first storage chamber, a second temperature sensor 79 disposed in the second storage chamber W to sense the temperature of the second storage chamber, and a third temperature sensor 89 disposed in the third storage chamber C to sense the temperature of the third storage chamber.

The refrigerator may include a controller 220 for controlling the compressor 1 and the path switching device 10. The controller 220 may be an electronic circuit including a microprocessor, a logical electronic circuit, a custom integrated circuit, and the like.

The controller 220 may control the compressor 1 and the path switching device 10 according to the first storage chamber temperature sensed by the first temperature sensor 69, the second storage chamber temperature sensed by the second temperature sensor 79 and the third storage chamber storage sensed by the third temperature sensor 89.

The controller 220 may drive the compressor 1 if any one of a condition that the first storage chamber temperature is dissatisfied, a condition that the second storage chamber temperature is dissatisfied and a condition that the third storage chamber temperature is dissatisfied, is satisfied. In this case, the controller 220 may control the path switching device 10 in any one of a first mode, a second mode and a third mode.

The controller 220 may drive the condensing fan 24 upon driving the compressor 1. In addition, the controller 220 may drive the first storage chamber fan 64 in a mode in which refrigerant flows to the first evaporator 6, drive the second storage chamber fan 74 in a mode in which refrigerant flows to the second evaporator 7, and drive the third storage chamber fan 84 in a mode in which refrigerant flows to the third evaporator 8.

The refrigerator of the present embodiment may be a cycle in which the second evaporator 7 and the first evaporator 6 are connected in series, the refrigerant bypasses the second evaporator 7 and flows to the first evaporator 6, and the first evaporator 6 and the second evaporator 7 connected in series are connected to the third evaporator 8 in parallel.

Meanwhile, the refrigerator may be configured such that at least one of the first evaporator 6 and the second evaporator 7 is connected to the third evaporator 8 in series. In this case, in the refrigerator, the refrigerant, which has passed through the first evaporator 6, or the refrigerant, which has passed through the second evaporator 7, may be sucked into the compressor 1 through the third evaporator 8. However, as described above, when at least one of the first evaporator 6 and the second evaporator 7 is connected to the third evaporator 8 in series, it is not easy to cool the first storage chamber R or the second storage chamber W using the first evaporator 6 or the second evaporator 7 while defrosting operation for defrosting the third evaporator 8 is performed. In this case, it is not easy to maintain the first storage chamber R or the second storage chamber W at a constant temperature.

In contrast, as in the present embodiment, if the first evaporator 6 and the second evaporator 7 are configured as a path independent of the third evaporator 7, the refrigerant may be supplied to the first evaporator 6 and the second evaporator 7 when the third evaporator 8 is defrosted, the first storage chamber R and the second storage chamber W may be cooled while the third evaporator 8 is defrosted, and the first storage chamber R or the second storage chamber W may be maintained at a constant temperature as much as possible. In the present embodiment, while the first evaporator 6 or the second evaporator 7 is defrosted, the refrigerant may pass through the third evaporator 8 and the temperature of the third storage chamber C may rapidly reach a target temperature.

Figure 4:
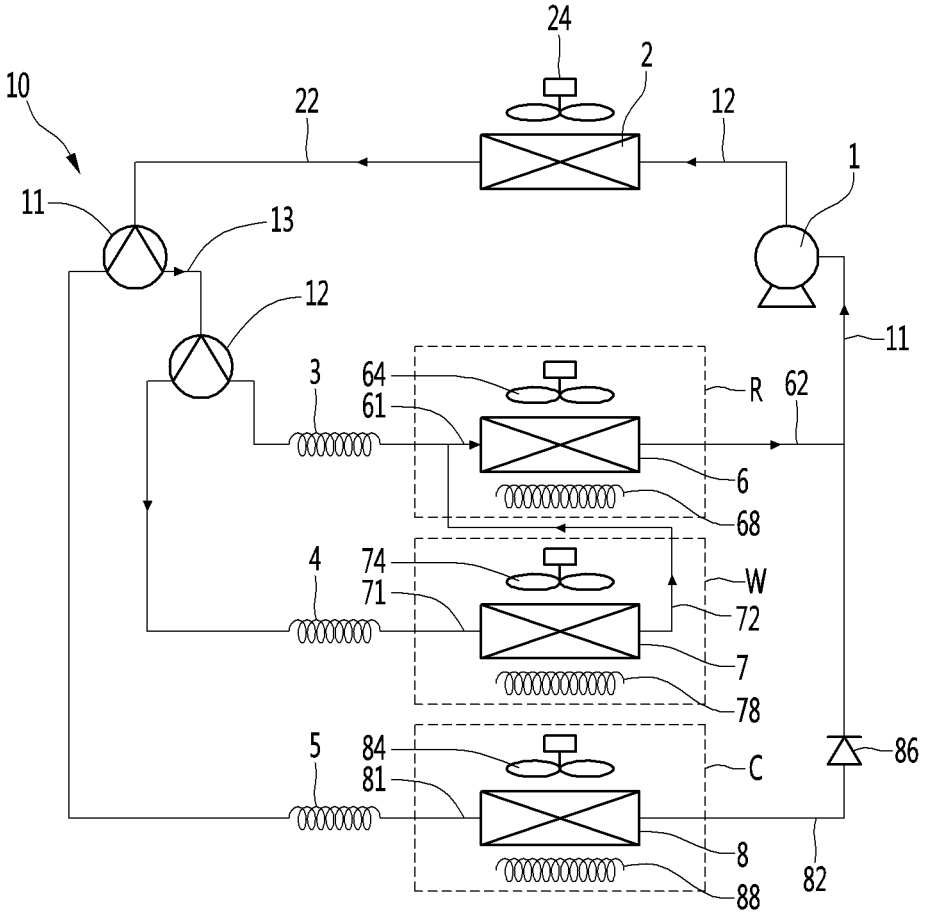
FIG. 4 is a view showing flow of refrigerant when the refrigerator according to the embodiment of the present disclosure is in a first mode.
Figure 5:
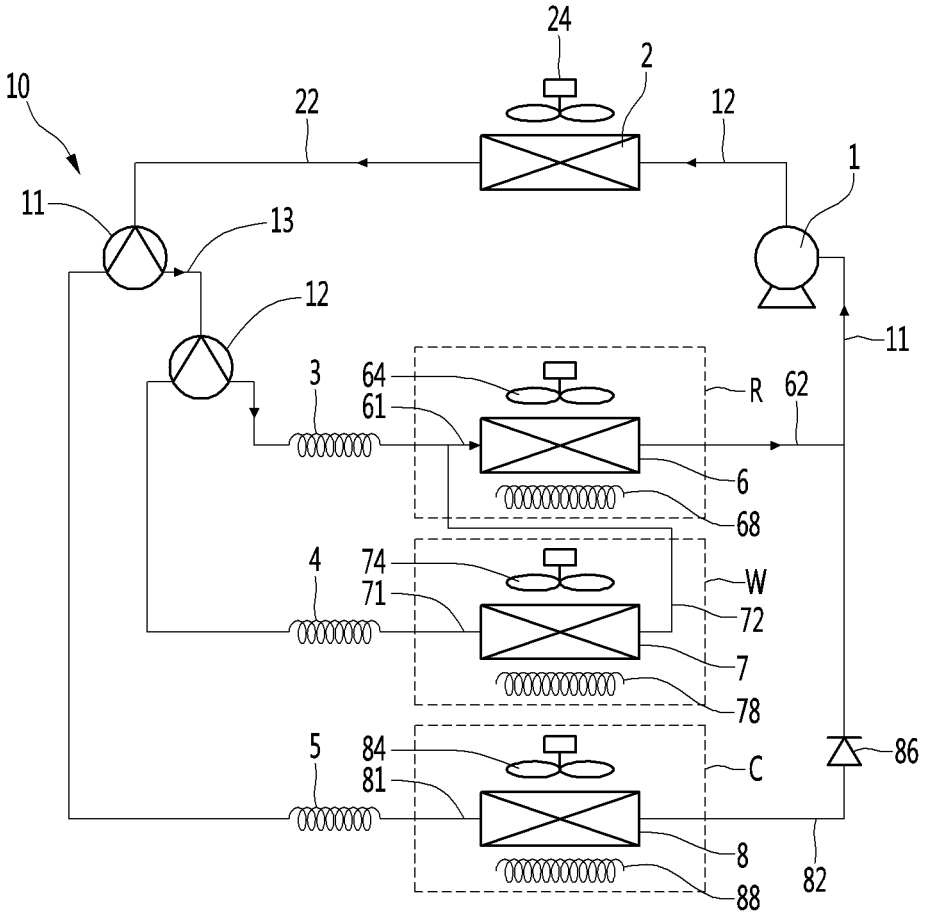
FIG. 5 is a view showing flow of refrigerant when the refrigerator according to the embodiment of the present disclosure is in a second mode.
Figure 6:
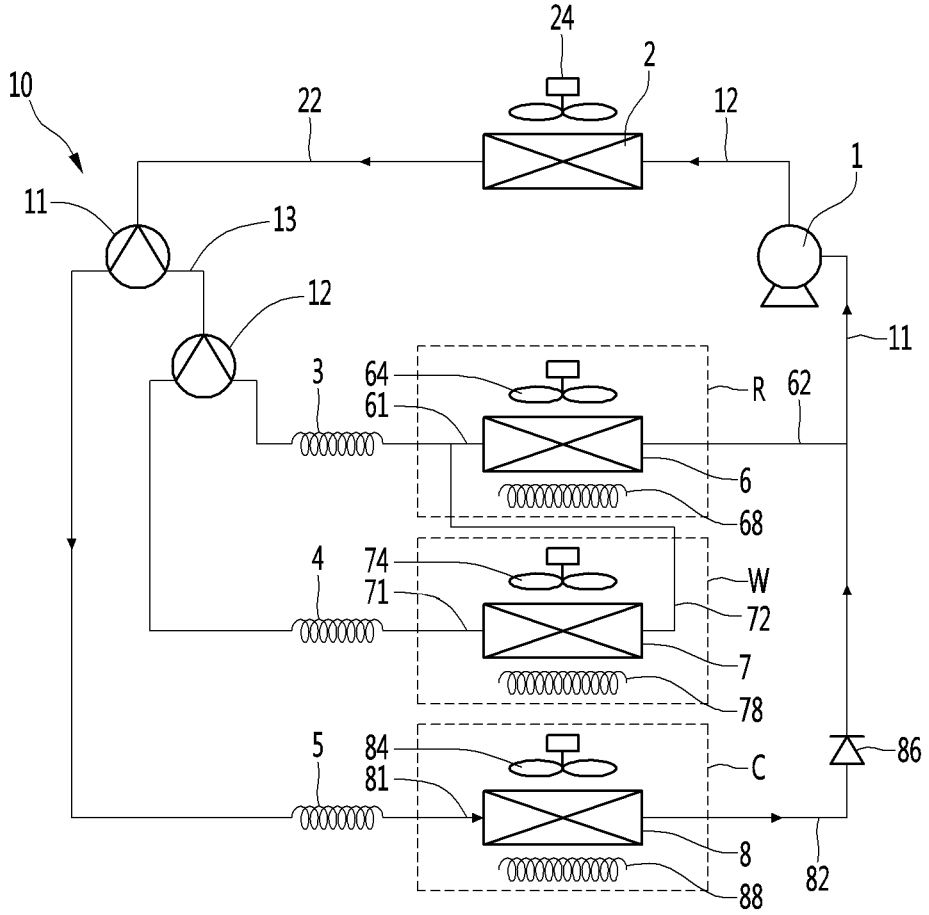
FIG. 6 is a view showing flow of refrigerant when the refrigerator according to the embodiment of the present disclosure is in a third mode.
Figure 7:
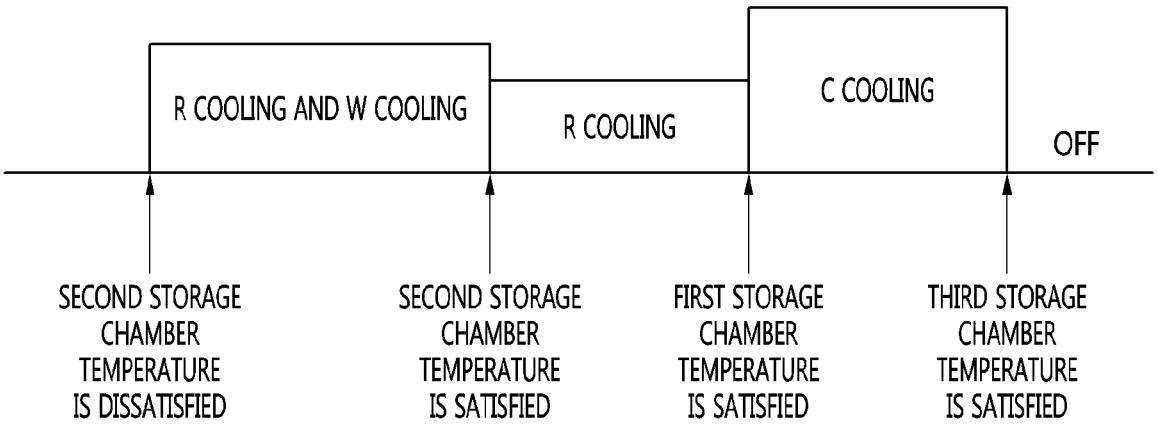
FIG. 7 is a view showing an order of cooling a plurality of storage chambers in the refrigerator according to the embodiment of the present disclosure.

FIG. 4 is a view showing flow of refrigerant when the refrigerator according to the embodiment of the present disclosure is in a first mode, FIG. 5 is a view showing flow of refrigerant when the refrigerator according to the embodiment of the present disclosure is in a second mode, FIG. 6 is a view showing flow of refrigerant when the refrigerator according to the embodiment of the present disclosure is in a third mode, and FIG. 7 is a view showing an order of cooling a plurality of storage chambers in the refrigerator according to the embodiment of the present disclosure.

As shown in FIG. 4, the controller 220 may perform the first mode (R cooling and W cooling) by controlling the path switching device 10 in a second evaporator supply mode such that the refrigerant is supplied to both the first evaporator 6 and the second evaporator 7.

The controller 220 may control the first three-way valve 11 in a second three-way valve guide mode and control the second three-way valve 12 in a second evaporator guide mode, in the first mode.

Start/end of the first mode (R cooling and W cooling) may be determined according to satisfaction/dissatisfaction of the second storage chamber temperature, and the first mode may start if the second storage chamber temperature is dissatisfied and terminate if the second storage chamber temperature is satisfied.

The controller 220 may drive the first storage chamber fan 64 and the second storage chamber fan 74 while driving the compressor 1, and drive the condensing fan 24, in the first mode. In addition, the controller 220 may maintain stoppage of the third storage chamber fan 84 in the first mode.

In the first mode, as shown in FIG. 4, the refrigerant compressed in the compressor 1 may be condensed while passing through the condenser 2 and guided to the second expansion device 4 by the path switching device 10. The refrigerant guided to the second expansion device 4 may be decompressed by the second expansion device 4 and pass through the second evaporator 7 to cool the second storage chamber W. The refrigerant, which has passed through the second evaporator 7, may cool the first storage chamber R while passing through the first evaporator 6. As described above, the refrigerant, which has sequentially passed through the second evaporator 7 and the first evaporator 6, may be sucked into the compressor 1.

In the first mode, the first storage chamber R and the second storage chamber W may be cooled together and may be cooled independently of the third storage chamber C.

In the first mode, the refrigerant may pass through the second evaporator 7 and the first evaporator 6 in this order and the second storage chamber temperature may be satisfied earlier than the first storage chamber temperature.

The controller 220 may stop the second storage chamber fan 74 if the second storage chamber temperature is satisfied in the first mode.

As shown in FIG. 5, the controller 220 may perform the second mode (R cooling) by controlling the path switching device 10 in the first evaporator supply mode such that the refrigerant is supplied to the first evaporator 6. The controller 220 may control the first three-way valve 11 in the second three-way valve guide mode and control the second three-way valve 12 in the first evaporator guide mode, in the second mode.

Start/end of the second mode (R cooling) may be determined according to satisfaction/dissatisfaction of the first storage chamber temperature, and the second mode may start if the first storage chamber temperature is dissatisfied and terminate if the first storage chamber temperature is satisfied. The controller 220 may perform the second mode until the temperature of the first storage chamber R is satisfied after the second mode starts.

In the second mode, the controller 220 may drive the first storage chamber fan 64 while driving the compressor 1, and may drive the condensing fan 24. In addition, the controller 220 may maintain stoppage of the second storage chamber fan 74 and the third storage chamber fan 84.

In the second mode, as shown in FIG. 5, the refrigerant compressed in the compressor 1 may be condensed while passing through the condenser 2 and guided to the first expansion device 3 by the path switching device 10. The refrigerant guided to the first expansion device 3 may be decompressed by the first expansion device 3, may pass through the first evaporator 6 to cool the first storage chamber R, and then may be sucked into the compressor 1.

In the second mode, the first storage chamber R may be cooled, and may be cooled alone independently of the second storage chamber W and the third storage chamber C.

The controller 220 may stop the first storage chamber fan 64 when the first storage chamber temperature is satisfied in the second mode.

As shown in FIG. 6, the controller 220 may perform the third mode (C cooling) by controlling the path switching device 10 in the third evaporator supply mode such that the refrigerant is supplied to the third evaporator 8. The controller 220 may control the first three-way valve 11 in the third evaporator supply mode in the third mode.

Start/end of the third mode (C cooling) may be determined according to satisfaction/dissatisfaction of the third storage chamber temperature, and the third mode may start if the third storage chamber temperature is dissatisfied and terminate if the third storage chamber temperature is satisfied. The controller 220 may perform the third mode until the third storage chamber temperature is satisfied, after the third storage chamber temperature is dissatisfied.

In the third mode, the controller 220 may drive the third storage chamber fan 84 while driving the compressor 1, and may drive the condensing fan 24. In addition, the controller 220 may maintain stoppage of the first storage chamber fan 64 and the second storage chamber fan 74.

In the third mode, as shown in FIG. 6, the refrigerant compressed in the compressor 1 may be condensed while passing through the condenser 2 and guided to the third expansion device 5 by the path switching device 10. The refrigerant guided to the third expansion device 5 may be decompressed by the third expansion device 5, may pass through the third evaporator 8 to cool the third storage chamber C, and may be sucked into the compressor 1.

In the third mode, the third storage chamber C may be cooled alone.

The controller 220 may stop the third storage chamber fan 84 if the third storage chamber temperature is satisfied in the third mode.

The controller 220 may selectively perform the first mode (R cooling and W cooling, see FIG. 4), the second mode (R cooling, see FIG. 5) and the third mode (C cooling, see FIG. 6).

As shown in FIG. 7, the controller 220 may sequentially perform the first mode (R cooling and W cooling), the second mode (R cooling) and the third mode (C cooling). In addition, the controller 220 may resume the first mode (R cooling and W cooling) after the third mode (C cooling). The controller 220 may terminate the third mode (C cooling) and immediately perform the first mode (R cooling and W cooling) if the third storage chamber temperature is satisfied and the second storage chamber temperature is dissatisfied.

In contrast, the controller 220 may maintain the off state of the compressor 1 until the second storage chamber temperature is dissatisfied after the third mode (C cooling) terminates, where the third storage chamber temperature is satisfied and the second storage chamber temperature is satisfied in the third mode (C cooling), and perform the first mode (R cooling and W cooling) if the second storage chamber temperature is dissatisfied while the compressor 1 is in the off state.

When the refrigerator is controlled in the first mode, the second mode and the third mode, the refrigerator may cool the first storage chamber R and the second storage chamber C together, cool the first storage chamber R, and then cool the third storage chamber C.

In this case, the first storage chamber R and the second storage chamber W of the refrigerator, which need to be maintained at a constant temperature, may be cooled prior to the third storage chamber C. In particular, in the first mode, since the first storage chamber R and the second storage chamber W are cooled together, it is possible to rapidly cool both the first storage chamber R and the second storage chamber W.

According to the embodiments of the present disclosure, the first storage chamber, the second storage chamber and the third storage chamber may be independently cooled.

In addition, since the first storage chamber and the second storage chamber or the first storage chamber can be cooled independently the third storage chamber, it is possible to maximally maintain the first storage chamber and the second storage chamber at constant temperatures as much as possible.

The above-disclosed subject matter is to be considered illustrative, and not restrictive, and the appended claims are intended to cover all such modifications, enhancements, and other embodiments, which fall within the scope of the present disclosure.

Thus, the embodiments of the present disclosure is to be considered illustrative, and not restrictive.

Therefore, the scope of the claimed invention is defined not by the detailed description of the disclosure but by the appended claims, and all differences within the scope should be construed as being included in the appended claims.

What is claimed is:

1. A refrigerator comprising:

a main body including a first storage chamber, a second storage chamber and a third storage chamber;

a compressor connected with a compressor suction path and a compressor discharge path;

a condenser connected with the compressor discharge path and a condenser outlet path; a first evaporator to cool the first storage chamber and connected with a first evaporator inlet path and a first evaporator outlet path;

a second evaporator to cool the second storage chamber and connected with a second evaporator inlet path and a second evaporator outlet path;

a third evaporator to cool the third storage chamber and connected with a third evaporator inlet path and a third evaporator outlet path;

a valve connected with the condenser outlet path and the first evaporator inlet path, the second evaporator inlet path and the third evaporator inlet path; and a controller to control the compressor and the valve based on at least one mode, wherein:

the first evaporator inlet path is directly connected to the valve and the first evaporator outlet path is directly connected to the compressor suction path downstream of the third evaporator, the second evaporator inlet path is directly connected to the valve and the second evaporator outlet path is directly connected to the first evaporator inlet path, and the third evaporator inlet path is directly connected to the valve and the third evaporator outlet path is directly connected to the compressor suction path.

2. The refrigerator of claim 1, further comprises:

a first storage chamber fan;

a second storage chamber fan;

a third storage chamber fan; and a condenser fan.

3. The refrigerator of claim 1, wherein a maximum target temperature of the third storage chamber is lower than each of a maximum target temperature of the first storage chamber and a maximum target temperature of the second storage chamber.

4. The refrigerator of claim 1, further comprises a check valve to prevent refrigerant of the compressor suction path from flowing back to the third evaporator.

5. The refrigerator of claim 1, wherein the second storage chamber is located between the first storage chamber and the third storage chamber.

6. The refrigerator of claim 1, wherein a difference between a target temperature upper-limit value and a target temperature lower-limit value of each of the first storage chamber and the second storage chamber is less than a difference between a target temperature upper-limit value and a target temperature lower-limit value of the third storage chamber.

7. The refrigerator of claim 1, wherein the controller selectively performs:

a first mode to control the valve in a second evaporator supply mode such that refrigerant is supplied to both the first evaporator and the second evaporator;

a second mode to control the valve in a first evaporator supply mode such that the refrigerant is supplied to the first evaporator; and a third mode to control the valve in a third evaporator supply mode such that refrigerant is supplied to the third evaporator.

8. The refrigerator of claim 7, wherein the controller:

performs the first mode until a temperature of the second storage chamber is satisfied;

performs the second mode until a temperature of the first storage chamber is satisfied, after the temperature of the second storage chamber is satisfied; and performs the third mode until a temperature of the third storage chamber is satisfied, after the temperature of the first storage chamber is satisfied.

9. The refrigerator of claim 7, wherein the controller:

starts the first mode if the temperature of the second storage chamber is dissatisfied; and ends the first mode if the temperature of the second storage chamber is satisfied.

10. The refrigerator of claim 7, wherein the controller:

starts the second mode if the temperature of the first storage chamber is dissatisfied; and ends the second mode if the temperature of the first storage chamber is satisfied.

11. The refrigerator of claim 7, wherein the controller terminates the third mode and resumes the first mode, if the temperature of the third storage chamber is satisfied and the temperature of the second storage chamber is dissatisfied in the third mode.

12. The refrigerator of claim 7, wherein, in the first mode, the controller drives the compressor, the first storage chamber fan, the second storage chamber fan, and the condensing fan, and does not drive the third storage chamber fan.

13. The refrigerator of claim 7, wherein, in the second mode, the controller drives the compressor, the first storage chamber fan, and the condensing fan, and does not drive the second storage chamber fan and the third storage chamber fan.

14. The refrigerator of claim 7, wherein, in the third mode, the controller drives the compressor, the third storage chamber fan, and the condensing fan, and does not drive the first storage chamber fan and the second storage chamber fan.

15. The refrigerator of claim 7, wherein the controller terminates the third mode and stops the compressor and the third storage chamber fan when the temperature of the third storage chamber is satisfied and the temperature of the second storage chamber is satisfied in the third mode.

16. The refrigerator of claim 1, wherein a temperature range of the second storage chamber is equal to or lower than that of the first storage chamber and is higher than that of the third storage chamber.

17. The refrigerator of claim 16, wherein a temperature range of the first storage chamber is 12 C to 18 C, a temperature range of the second storage chamber is 12 C to 18 C or 6 C to 11 C, and a temperature range of the third storage chamber is 0 C to 7 C or −2 C to 0 C or −24 C to −16 C.

18. The refrigerator of claim 1, further comprises a heater to defrost the third evaporator.

19. The refrigerator of claim 18, wherein in a defrosting mode, the controller drives the heater and the third storage chamber fan while the compressor is operated.

20. A refrigerator comprising:

a main body including a first storage chamber, a second storage chamber and a third storage chamber;

a compressor connected with a compressor suction path and a compressor discharge path;

a condenser connected with the compressor discharge path and a condenser outlet path;

a first evaporator to cool the first storage chamber and connected with a first evaporator inlet path and a first evaporator outlet path being connected to the compressor suction path;

a second evaporator to cool the second storage chamber and connected with a second evaporator inlet path and a second evaporator outlet path being connected to the first evaporator inlet path;

a third evaporator to cool the third storage chamber and connected with a third evaporator inlet path and a third evaporator outlet path being connected to the compressor suction path;

a valve connected with the condenser outlet path and the first evaporator inlet path, the second evaporator inlet path and the third evaporator inlet path; and a controller to control the compressor and the valve based on at least one mode, wherein the controller selectively performs:

a first mode to control the valve in a second evaporator supply mode such that refrigerant is supplied to both the first evaporator and the second evaporator;

a second mode to control the valve in a first evaporator supply mode such that the refrigerant is supplied to the first evaporator; and a third mode to control the valve in a third evaporator supply mode such that refrigerant is supplied to the third evaporator.

21. The refrigerator of claim 20, wherein the controller:

starts the first mode if the temperature of the second storage chamber is dissatisfied; and ends the first mode if the temperature of the second storage chamber is satisfied.

22. The refrigerator of claim 20, wherein the controller:

starts the second mode if the temperature of the first storage chamber is dissatisfied; and ends the second mode if the temperature of the first storage chamber is satisfied.

23. The refrigerator of claim 20, wherein the controller terminates the third mode and resumes the first mode, if the temperature of the third storage chamber is satisfied and the temperature of the second storage chamber is dissatisfied in the third mode.

24. The refrigerator of claim 20, wherein, in the first mode, the controller drives the compressor, the first storage chamber fan, the second storage chamber fan, and the condensing fan, and does not drive the third storage chamber fan.

25. The refrigerator of claim 20, wherein, in the second mode, the controller drives the compressor, the first storage chamber fan, and the condensing fan, and does not drive the second storage chamber fan and the third storage chamber fan.

26. The refrigerator of claim 20, wherein, in the third mode, the controller drives the compressor, the third storage chamber fan, and the condensing fan, and does not drive the first storage chamber fan and the second storage chamber fan.

27. The refrigerator of claim 20, wherein the controller terminates the third mode and stops the compressor and the third storage chamber fan when the temperature of the third storage chamber is satisfied and the temperature of the second storage chamber is satisfied in the third mode.

* * * * *